US005416293A

United States Patent [19]

Reneau

[11] Patent Number: 5,416,293

[45] Date of Patent: May 16, 1995

[54] SHOCK SENSOR INCLUDING A COMPOUND HOUSING AND MAGNETICALLY OPERATED REED SWITCH

[75] Inventor: Daniel R. Reneau, Madison, Wis.

[73] Assignee: Hamlin, Inc., Lake Mills, Wis.

[21] Appl. No.: 292,340

[22] Filed: Aug. 17, 1994

[51] Int. Cl.[6] ..... H01H 35/14

[52] U.S. Cl. ..... 200/61.45 M; 200/61.53; 335/205

[58] Field of Search ..... 200/61.45 R, 61.45 M, 200/61.48, 61.52, 61.53; 335/151, 154, 205, 206, 207

[56] References Cited

U.S. PATENT DOCUMENTS

| | | | |
|---|---|---|---|
| 3,247,343 | 4/1966 | Van Wagener et al. | 335/154 |
| 3,465,271 | 9/1969 | Koepke | 335/205 |
| 3,559,124 | 1/1971 | Posey | 335/205 |
| 3,588,401 | 6/1971 | Berryman | 200/61.48 |
| 3,795,780 | 3/1974 | Lawrie | 200/61.45 R |
| 3,804,999 | 4/1974 | Hubbard | 200/80 R |
| 3,853,199 | 12/1974 | Hirashima et al. | 180/274 |
| 4,016,535 | 4/1977 | Dinlocker | 340/440 |
| 4,117,430 | 9/1978 | Sims, Jr. | 335/205 |
| 4,453,148 | 6/1984 | Norakidze et al. | 335/205 |
| 4,456,897 | 6/1984 | Holce et al. | 335/205 |
| 4,463,312 | 7/1984 | Oda et al. | 324/174 |
| 4,484,041 | 11/1984 | Andres et al. | 200/61.45 M |
| 4,518,835 | 5/1986 | Grosser | 20/61.45 M |
| 4,700,163 | 10/1987 | Wolfe, Jr. | 335/205 |
| 4,705,922 | 11/1987 | Seeger et al. | 200/61.45 M |
| 4,737,751 | 4/1988 | Risk | 335/207 |
| 4,820,888 | 4/1989 | Shields | 200/61.45 M |
| 4,877,927 | 10/1989 | Reneau | 200/61.45 M |
| 4,965,416 | 10/1990 | Bachmann | 200/61.45 M |
| 4,980,526 | 12/1990 | Reneau | 200/61.45 M |
| 4,987,276 | 1/1991 | Bader et al. | 200/61.45 M |
| 5,128,641 | 7/1992 | Posey | 335/151 |
| 5,194,706 | 3/1993 | Reneau | 200/61.45 R |
| 5,212,357 | 5/1993 | Reneau | 200/61.45 M |
| 5,237,134 | 8/1993 | Thuen et al. | 200/61.45 M |
| 5,248,861 | 9/1993 | Kato et al. | 200/61.45 M |
| 5,293,523 | 3/1994 | Posey | 335/205 |

FOREIGN PATENT DOCUMENTS

| | | |
|---|---|---|
| 2161233 | 6/1973 | France . |
| 1287186 | 1/1969 | Germany . |
| 3830782 | 6/1990 | Germany . |

*Primary Examiner*—J. R. Scott
*Attorney, Agent, or Firm*—Lathrop & Clark

[57] ABSTRACT

A shock sensor has a housing with two portions. A first portion resiliently engages a reed switch which has staple formed leads. A second portion extends adjacent one of the reed switch leads and has modular components which permit consistent shock-sensing results to be obtained from reed switches of varying sensitivity by selection of appropriate components. The second portion is a closed-ended hollow tube in which a bobbin with a centrally located guide bar is inserted. A first disk extends outwardly from the guide bar. A self-test coil is positioned on the bar between the first disk and a second disk. A biasing spring extends between the closed end of the tube and the magnet, which is mounted on the bar. The magnet is abutted against a second disk which extends from the bar. The second disk positions the actuation magnet with respect to the reed switch when it is in its non-actuated position. By substituting different bobbin and the actuation springs, shock sensors are easily created which achieve identical functions with reed switches of varying amp turn requirements for actuation.

17 Claims, 3 Drawing Sheets

SHOCK SENSOR INCLUDING A COMPOUND HOUSING AND MAGNETICALLY OPERATED REED SWITCH

FIELD OF THE INVENTION

This invention relates to shock sensors in general and to shock sensors employing reed switches in particular.

BACKGROUND OF THE INVENTION

Shock sensors employing reed switches am used in motor vehicles to detect a vehicle collision. When a collision occurs, the shock sensor triggers an electrical circuit for the actuation of safety devices such as inflating air bags, tensioning seat belts, and other similar systems. Such shock sensors typically employ a reed switch with an acceleration sensing magnet which is biased by a spring away from an activation region of the reed switch such that the reed switch is open when the shock sensor is not subject to acceleration.

When the vehicle and the shock sensor, which is attached to the vehicle, are subject to a crash-induced acceleration, the magnet acts as an acceleration-sensing mass. The magnet moves relative to the central activation region and exposes the reeds of the switch to a magnetic field, which causes the reeds to mutually attract and close the reed switch. I have disclosed in my earlier patent, U.S. Pat. No. 5,194,706, a shock sensor employing end-actuation in a compact package. My previously disclosed shock sensor achieves considerable advantages in reduced package size which facilitates placement of the shock sensor within the automobile. Placement of shock sensors may be critical to reliable and effective operation since smaller sensors may be readily placed in effective locations. My previous sensor achieved improved minimum dwell times through the shaping of the magnet and the employment of the end-actuation region of a reed switch. Reed switches, as typically manufactured, have a fairly wide range in magnetic field strength (measured in amp turns) required for their actuation. Thus, manufactured reed switches are normally tested and sorted according to field strength requirements for actuation. A certain number of reed switches must be discarded if outside the usable range for a particular shock sensor construction.

As crash actuated safety devices become standard in more cars and trucks, shock sensors are increasingly in demand. Features which can reduce costs in manufacturing are especially desireable. Particularly, a shock sensor is needed which has a reduced part count which is adaptable to machine assembly and which may be readily adapted to accommodate the unique tolerancing variation associated with reed switches.

SUMMARY OF THE INVENTION

The shock sensor of this invention employs a housing with two portions. The first portion of the housing resiliently engages a reed switch which has staple formed depending leads. The housing second portion extends adjacent one end of the reed switch. The second portion is a hollow tube which defines a cylindrical shaft with a closed end. A bobbin comprised of a central guide bar with two axially spaced radially-extending disks is inserted into the open end. A biasing spring extends between the closed end and an actuation magnet slidably mounted on the guide bar. A reed switch self-test coil is wrapped about the guide bar between the two disks. The biasing magnet is separated from the self-test coil by the one of the disks which positions the actuation magnet with respect to the reed switch when it is in its non-actuated position. The magnet thus travels between the disk and the closed end of the housing second portion.

Because reed switches will have varying responses to proximity of the actuation magnet, the shock sensor of this invention permits different bobbins and springs to be inserted within a common housing to ensure consistent shock sensor operation despite the reed switch sensitivity. By substituting bobbins with greater or lesser spacing between the disks and the closed end of the housing second portion, the actuation magnet may be displaced a greater or lesser distance from the reed switch and hence the activation region may be tailored to the attributes of the particular reed switch as determined by testing. Biasing springs of common length but of greater or lesser spring constant are also inserted to achieve the desired identical functions with reed switches of varying amp turn requirements for actuation. The biasing spring is adjusted for each category of reed switches with a given actuation amp turn range by varying the number of touching turns of the actuation spring. Touching turns are turns of the spring which are not displaced laterally from each other and thus impart no resistance to compression of the spring. The packaging design achieves significant reduction in piece parts for the individual shock sensor. In addition, the entire family of shock sensors necessary to utilize the majority of the particular manufacturing lot of reed switches may be manufactured with even more significant decrease in part count.

The first portion of the housing has a downwardly opening hole adjacent to the end of the tube formed by the second portion and centrally located with respect to the second portion. A staple formed reed switch, that is a reed switch having leads bent downwardly in the shape of a staple, is preferably machine-positioned with one leg or lead inserted into the downwardly opening hole. The reed switch may then be swung against a linearly extending resilient beam wherein the downwardly extending lead opposite the one contained in the hole is resiliently held by a retaining feature on the resilient beam.

Another feature of the shock sensor of this invention is that the actuation magnet is strongly attracted to the reed switch lead which goes down the downwardly opening hole. This attraction force offsets the spring force which provides design parameters which allow an increase in dwell or minimum dwell and allow the possibility of designing a latching shock sensor.

The self-test coil, while providing the ability to test the shock sensor by moving the actuation magnet due to an induced magnetic field in the coil also serves two additional functions. The first of these is the ability to unlatch a shock sensor which has been designed to latch. The second function is the ability to adaptively change the characteristics of the reed switch. In a typical crash-sensing system, a number of shock sensors, and possibly other types of sensors, are positioned around the vehicle to detect vehicle impacts on various quadrants. If over the life of the vehicle, one or more sensors becomes inoperative, repair is very difficult because the functioning of the sensor depends on its being properly positioned and mounted to respond as designed. Therefore, the preferred mode of repair may be to design the system to adaptively reconfigure to compensate for the loss of one sensor by adjustments in the sensitivities of other sensors so that the shock sensing system as a whole is fault tolerant and continues to operate effectively despite loss of functionality of some of its components.

It is an object of the present invention to provide a shock sensor of more cost-effective manufacture.

It is another object of the present invention to provide a shock sensor which is assembled from fewer piece parts.

It is yet another object of the present invention to provide a shock sensor employing a reed switch wherein the reed switch may be readily machine-placed on the shock sensor housing.

It is a still further object of the present invention to provide a shock sensor which may be hermetically sealed.

It is a yet further object of the present invention to provide an end activation of two or more reed switches.

It is yet another object of the present invention to provide a shock sensor which may readily be adapted to incorporate reed switches of varying magnetic sensitivity.

It is a still further object of the present invention to provide an end activated reed switch sensor which is self-testing.

It is a yet further object of the present invention to provide a shock sensor which will latch in the actuated position.

It is a still further object of the present invention to provide a shock sensor with actuation parameters which may be adjusted after assembly and installation in a vehicle.

Further objects, features, and advantages of the invention will be apparent from the following detailed description when taken in conjunction with the accompanying drawings.

DESCRIPTION OF THE PREFERRED EMBODIMENTS

Figures 1, 2, 3, 4:
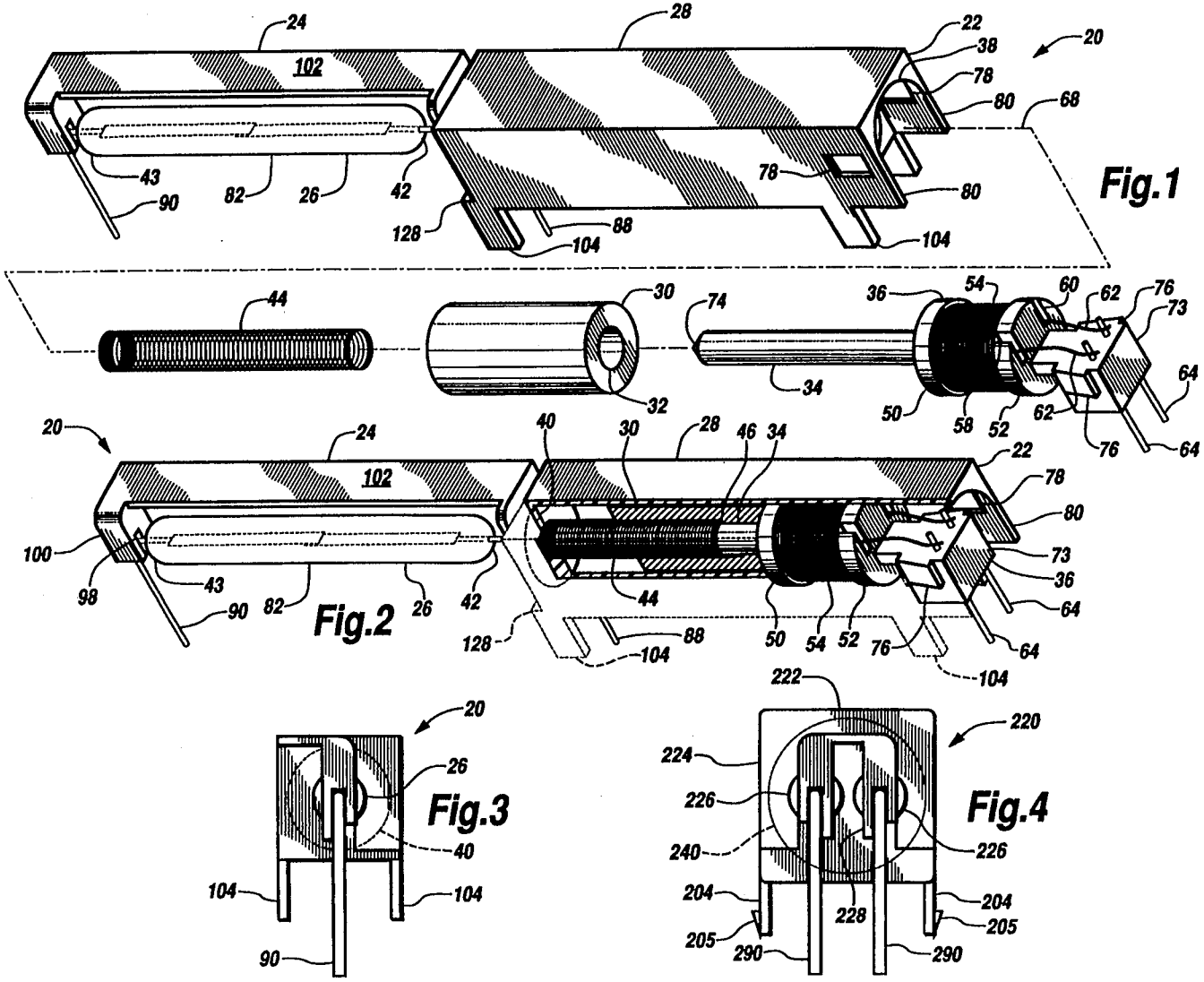
FIG. 1 is an exploded, isometric view of the shock sensor of this invention.
FIG. 2 is an isometric view, partly cut away, of the shock sensor of FIG. 1.
FIG. 3 is an end view of the shock sensor of FIG. 7 taken along line 3-3.
FIG. 4 is an end view of an alternative embodiment shock sensor employing two reed switches.
Figure 5:
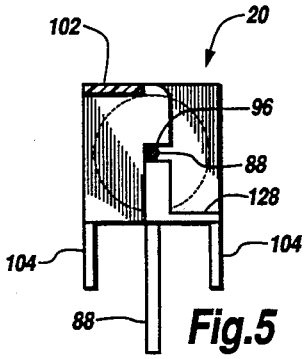
FIG. 5 is a cross-sectional view of the shock sensor of FIG. 7 taken along section line 5–5.
Figure 6:
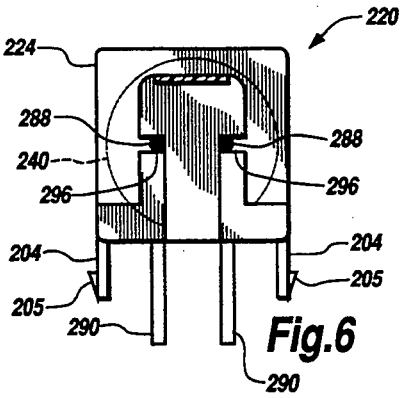
FIG. 6 is a cross-sectional view of the alternative embodiment shock sensor employing two reed switches of FIG. 4 taken through the first housing section.
Figure 7:
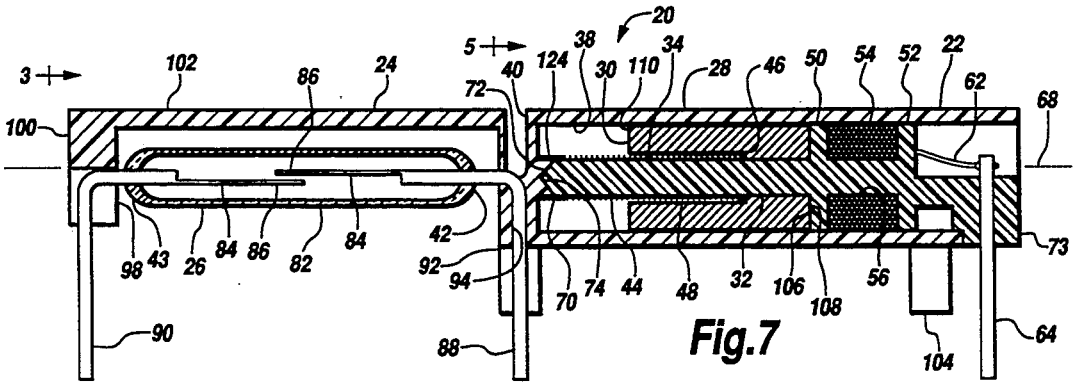
FIG. 7 is a cross-sectional view of the shock sensor of FIG. 1 shown in the non-actuated position.
Figure 8:
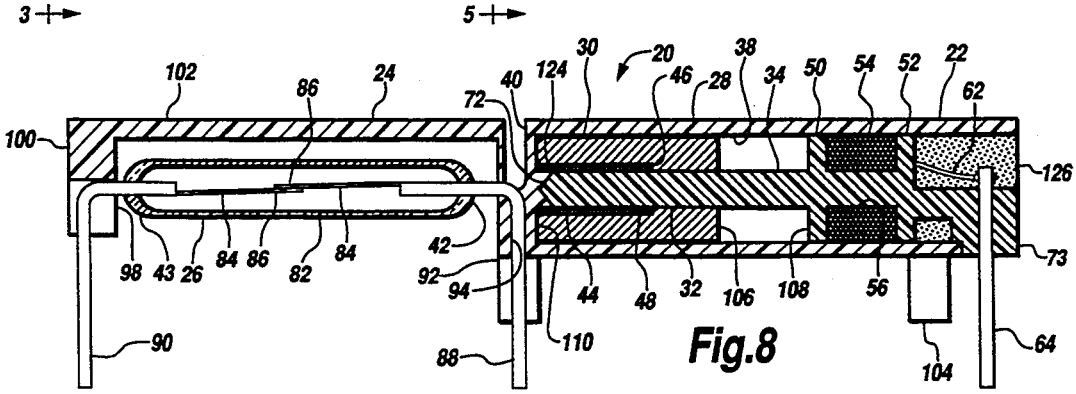
FIG. 8 is a cross-sectional view of the shock sensor of FIG. 1 shown in the actuated position.

Referring more particularly to FIGS. 1–10, wherein like numbers refer to similar parts, an improved end actuated shock sensor 20 is shown in FIGS. 1, 2, 7 and 8. Referring to FIG. 1, the shock sensor has a housing 22 which is divided into a first portion 24 which holds and positions the reed switch 26, and a second portion 28 which contains an actuation magnet 30. The actuation magnet 30 has a central bore 32 which is slidably engaged on the axially extending guide bar 34 of a molded plastic bobbin 36. As shown in FIGS. 2, 7 and 8, the bobbin 36 is inserted into a hollow tube 38 which is defined by the second portion 28 of the shock sensor housing 22. The second portion has a closed end 40 which terminates the hollow tube 38 and is adjacent to the housing first portion 24 and also spaced from a first end 42 of the reed switch 26. A biasing spring 44 is positioned about the guide bar 34 and extends between the closed end 40 of the housing second portion and a radially extending lip 46 in the central bore 32 of the magnet 30. The closed end 40 of the housing second portion forms a first abutment for the magnet 30, and the disk 50 forms a second abutment.

The bobbin 36 has a first radially extending disk 50 which is formed axisymmetrically about the bobbin guide bar 34. A second radially extending disk 52 is also formed on the guide bar 34 and is axially spaced from the first disk away from the reed switch 26 in the assembled shock sensor 20. A self-test coil 54 is wound on to a portion 56 of the guide bar 34 between the first disk 50 and the second disk 52. As shown in FIG. 1, the second disk 52 has a first slot 58 and a second slot 60 which pass the ends 62 of the coil 54. The coil ends 62 are soldered or welded to extending coil leads 64.

When the shock sensor 20 is assembled, as shown in FIG. 1, the bobbin 36 is centered and positioned within the hollow bore 38 of the housing second portion 28 of the shock sensor 20. The bobbin 36 is radially positioned by the first and second radial disks 50, 52 which engage the inside surface 61 of the hollow tube 38. The guide bar 34 has a conical end 74 which aids in aligning the guide bar along the axis 68 of the shock sensor 20 by engaging with a nubbin 70 which protrudes from the closed end 40 of the housing second portion 28 within the tube 38. The nubbin is smaller in diameter than the internal bore 32 of the magnet 30 and has a concave surface 72 which faces toward the bobbin disks and which engages with the conical end 74 of the guide bar 34. The bobbin 36 is positively retained within the hollow tube 38 by two tapered ears 76 which extend from the base 73 of the bobbin 36. The tapered ears 76 engage in openings 78 in the second portion 28 of the housing 22. The housing 22 is constructed of resilient plastic and the walls 80 of the housing 22 allow the passage of the ears 76 by resiliently deforming outwardly until the ears protrude through the openings 78 in the walls 80, thus positively locking the bobbin 36 within the hollow tube 38 of the housing second portion 28.

The reed switch 26 is formed of a glass capsule 82 which is fused about two reeds 84. The glass capsule 82 has a first end 42 adjacent to the housing second portion 28 and a second end 43 distal from the housing second portion 28. The reeds 84 have contact areas 86 which when brought into engagement, as shown in FIG. 8, close an electrical circuit between a first lead 88 and a second lead 90. The leads 88, 90 are bent downwardly at approximately 90 degrees from the axis 68 of the shock sensor 20 and reed switch 26. The so-called staple formed leads 88, 90 position the reed switch 26 on the first portion 24 of the housing 22.

A downwardly opening hole 94 is defined at the juncture 92 between the housing first portion 24 and the housing second portion 28. The first lead 88 extends through the hole 94. During assembly, the reed switch is assembled to the housing 22 by inserting the first lead 88 into the hole 94 with the reed switch 22 initially positioned approximately forty-five degrees from the axis 68 of the reed switch 20. The reed switch 26 is then swung into axial alignment so that the first lead 88 is engaged in a frontwardly facing notch 96 shown in FIG. 5.

The first housing portion has a slim resilient beam 102, shown in FIGS. 1 and 5, which extends the length of the reed switch from the juncture 92 to a downwardly depending member 100. The beam 102 is flexible to allow it to be deformed upwardly so that the second lead 90 can be positioned beneath the depending member 100. Once the beam is released the second lead 90 is engaged within a slot 98 formed in the depending member 100. The shock sensor 20 has relatively few individual piece parts. These individual parts are self-aligning and positioning on and within the housing 22, thus facilitating machine assembly of the components. Legs 104 extend downwardly from the housing 22 to position the shock sensor 20 above a circuit board (not shown), thus allowing the reed switch 20 to be mounted above other electrical components which are mounted to the circuit board.

The operation of the reed switch 20 is shown and illustrated in FIGS. 7 and 8. In the non-actuated position shown in FIG. 7, the first end 106 of the magnet 30 is disposed against the second abutment 108 formed by the first disk 50 of the bobbin. When the shock sensor 20 experiences an acceleration of sufficient magnitude with a sufficient component of acceleration aligned along the housing axis 68, the magnet 30, functioning as an acceleration sensing mass, moves towards the first end 42 of the reed switch 26. As shown in FIG. 8, the magnet 30 will be halted in its travel when the second end 110 of the magnet engages against the first abutment defined by the housing end 40. This travel of the magnet 30 brings it into an activation position, in which the magnetic field produced by the magnet causes the reed switch reeds 84 to mutually attract so that the contact surfaces 86 close the circuit between the leads 88 and 90.

The shock sensor 20 is not only readily assembled by machine, but may use reed switches of standard lead length and configuration. The shock sensor 20 has a compact package which is achieved by employing end activation of the reed switch such as disclosed in my previous patent, U.S. Pat. No. 5,194,706, the disclosure of which is hereby incorporated by reference herein.

Figure 9:
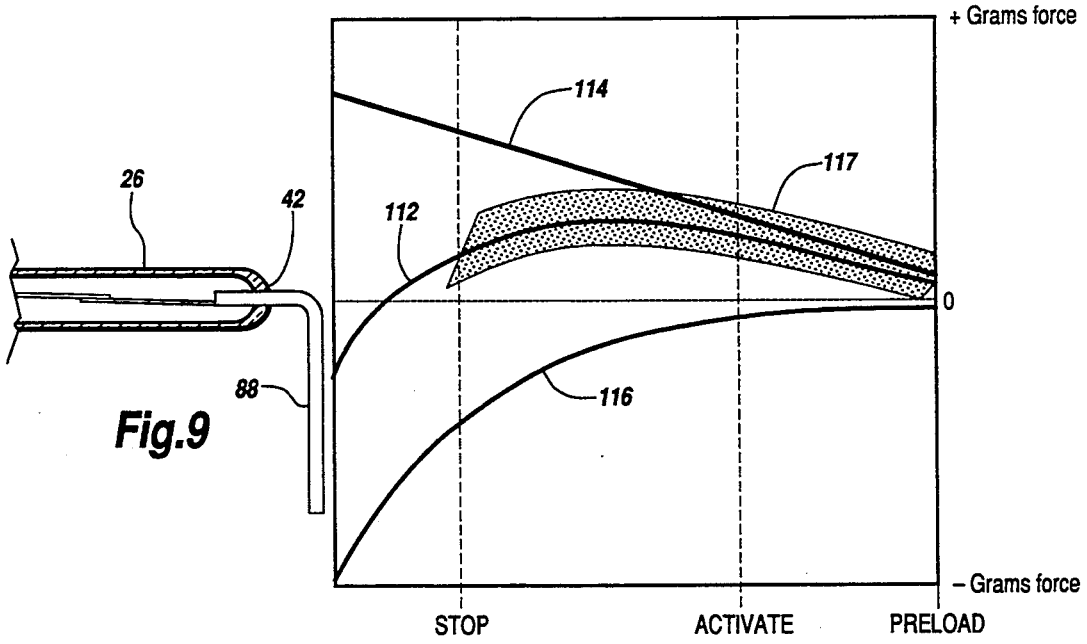
FIG. 9 is a graphical view showing the forces on the actuation magnet of a shock sensor of this invention, the graph being juxtaposed with a fragmentary cross-sectional view of a reed switch having an aligned x-axis.

The first lead 88 is preferably formed of a ferromagnetic material such as steel to create a magnetic attractive force between the magnet 30 and the lead 88. The shock sensor 20 utilizes the force of attraction between the magnet 30 and the first lead 88 to control the characteristics of the force-distance curve 112 shown in FIG. 9. In FIG. 9, the y-axis is delineated in grams force positive and grams force negative, with grams force positive being the force which holds the activation magnet 30 away from the first end 42 of the reed switch 26. Curve 114 is the spring force curve and illustrates how the force applied to the magnet 30 by the spring increases linearly as the magnet is moved along the x-axis towards the reed switch 26. Lower curve 116 is a plot of increasing magnetic attraction between the lead 88 and the actuation magnet 30 as the actuation magnet 30 moves along the x-axis toward the first end 42 of the reed switch 26. Thus the design of the shock sensor 20 takes advantage of the attractive force between a staple formed reed switch lead and the actuation magnet to add an additional parameter which may be utilized in the design of shock sensors advantageously to improve the design and to introduce new capabilities and functions.

FIG. 9 illustrates how the combination of the spring force represented by curve 114 and the magnetic attraction force represented by curve 116 combine to provide a force-distance curve 112 which achieves additional dwell time by reducing the return force acting on the magnet 30 between the activation point and the stop point. The pre-load position shown in FIG. 9 corresponds to the magnet 30 being positioned with its rear face 106 against the second abutment 108. The stop location corresponds to the magnet 30 having its second face 110 positioned adjacent to the first abutment 40. Activation takes place as the magnet 30 moves from the second abutment 108 to the first abutment 40. By decreasing the restoring force shown by curve 112, the dwell time of the activation for the shock sensor 20 may be extended.

In other words, because the attractive force between the magnet and the lead is opposite to the spring restorative force, the net force tending to open the reed switch is reduced. This reduction in force corresponds to a reduced acceleration of the magnet back to the unactivated position and hence an extended time to traverse the distance between the first abutment and the at-rest position.

Extended dwell times are highly desirable in improving the reliability of the operation of equipment driven by the shock sensor 20. If an activation time of a given length can be depended on, the overlap of contact closures of the shock sensor 20 and the contact closure of another shock sensor that may be activated in parallel to the shock sensor 20 in the crash sensing system, the overlap between sensors becomes greater, and thus the triggering of the safety devices based on both shock sensors becomes possible.

By proper selection of spring and magnet characteristics, the shock sensor 20 may be configured so that upon activation the magnet will latch with the reed switch in the activated position. A spring selected to have, for example, the spring activation curve 118, shown in FIG. 10, has a restorative force at the magnet stop position which is less than the attractive force between the magnet and the lead 88 at the same position, as indicated by the magnet attraction curve 120. The net force on the magnet at any position is illustrated by the force-distance curve 122. The net negative force at the stop position means that the magnet actuating the reed switch latches in the closed position. The shock sensor 20 may thus, by employing a properly configured spring 44 and magnet, provide a latching switch without the additional coil and current loop required in conventional latching reed switches.

Figure 10:
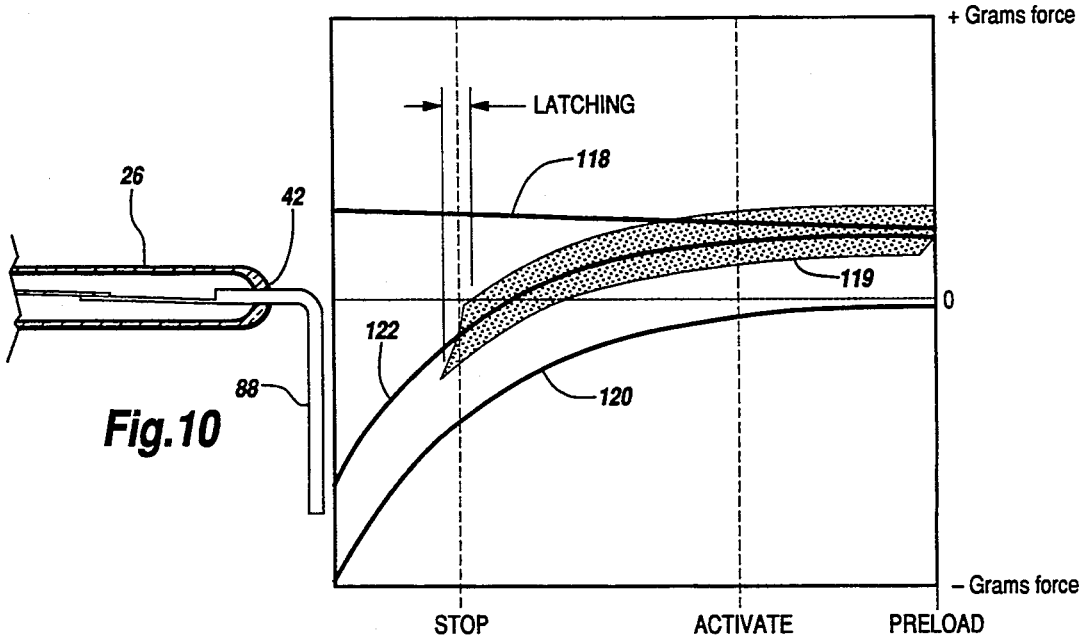
FIG. 10 is a graphical view of the forces on the actuation magnet of a shock sensor of this invention in which the magnet and spring are selected so that the reed switch will latch in the closed position. The graph is juxtaposed with a fragmentary cross-sectional view of the reed switch having an x-axis.

The shaded regions 117 in FIG. 9 and 119 in FIG. 10 represent the tolerance bands on the force-distance curves produced by variation in the individual components which make up the shock sensor 20. As illustrated in FIG. 10, the stop distance is chosen so that no permissible tolerance variation will prevent the reed switch of FIG. 10 from latching. In a similar way, the reed switch of FIG. 9 is configured so that latching will not occur within the permissible tolerance variations for the reed switch of FIG. 9.

The coil 54 can be used to achieve self-testing of the shock sensor 20 as disclosed in my earlier Rencau U.S. Pat. No. 4,980,526 et al. The coil may be used to perform two additional functions in the shock sensor 20. First, it may be used to unlatch the shock sensor 20 when it is configured as in FIG. 10. Secondly, the coil the may be used to adjust the actuation parameters of the shock sensor 20 so adjusting its sensitivity. This can be critical in applications in automobiles for actuating passive passenger restraint devices such as airbags and seatbelt locks. Because the placement of the shock sensor can be critical to the proper function in the event of a crash, it will often prove infeasible to repair or replace a faulty sensor. However because multiple sensors are employed on a single vehicle, adjustments in the sensitivity of the remaining sensors may be accomplished by supplying a biasing magnetic field to the coil 54 which will change the sensitivity of a shock sensor 20 allowing a crash detection system which continues to be functional despite the loss of one or more individual sensors.

In any batch of reed switches, as manufactured, the individual switches have a relatively wide distribution in the magnetic field strength required to close the switch. Thus, alter manufacture, the parts am normally tested to determine the required field strengths for actuation, typically measured in amp turns, and the switches are sorted into groups of with a narrow range of amp turn requirements for activation. The required production volume of a reed switch for employment in a typical automobile project may be several hundred thousand to a million or more. Each car requires multiple shock sensors employing one or more reed switches each. A year's production of a car is often in the hundreds of thousands. Thus, the feasibility of selecting reed switches of a particular functional range from a larger population of reed switches manufactured for all uses has practical problems in view of the sheer number of components required for a particular application. Further, to the extent that the specification required by a particular user of shock sensors is unique, a large population of reed switches to select from will not be available. Thus, in the normal practice, an entire family of shock sensors will need to be developed to provide one configuration of components to function with each group of reed switches falling within a particular amp turn tolerance range. This requirement of a multiplicity of shock sensors for a single application can be a serious impediment to holding down the overall cost of such shock sensors.

The shock sensor 20 of this invention may be modified to function with reed switches of varying amp turn requirements by modifying only two components. The first component which may be modified is the bobbin. By manufacturing a range of bobbins with the position of the second abutment 108 formed by the first bobbin disk 50 set closer or farther away from the reed switch end 42 along the guide bar 32, the pre-load position of the magnet 30 may be changed. The second bobbin disk 52 is relocated relative to placement changes of the first bobbin disk 50 and second abutment 108.

The second component which must be modified is the spring 44. As shown in FIG. 7, the spring 44 in its uncompressed state has a number of touching coils 124. By adjusting the number of touching coils in the manufacturing process of the spring, the spring characteristics may be adjusted without adjusting either the gauge of the wire forming the spring or the length of the wire forming the spring. Thus, by adjusting the two components, the spring 44 and the bobbin 36, the shock sensor 20 can be designed to provide similar activation characteristics when employed with reed switches of varying amp turn activation requirements. A production run of shock sensors with consistent performance characteristics may thus be manufactured using substantially all the reed switches from a production batch by sorting the reed switches into tolerance ranges and then assembling the reed switches within each group with a bobbin and spring of appropriate characteristics.

The shock sensor 20 also may be hermetically sealed by placing a sealant 126 such as an epoxy about the base 73 as shown in FIG. 8.

An alternative embodiment shock sensor 220 is shown in FIGS. 4 and 6. The shock sensor 220 employs two reed switches 226 mounted on the housing 222 which is divided into a first portion 224 and a second portion 228. The closed end 240 of the hollow tube (not shown) is indicated on FIGS. 4 and 6 and shows the relative size of the activation magnet (not shown) and shock sensing mechanism. The shock sensor 220 is otherwise similar in configuration and actuation mechanism to the shock sensor 20.

In circumstances where redundancy or circuit separation, such as driver-passenger or bag-belt, is required in the circuit closing capability of a shock sensor, the shock sensor 220 provides a compact, cost-effective package which is made feasible by the overall configuration, including the end activation of a shock sensor 220. As shown in FIGS. 4 and 6, shock sensor 220 has legs 204 which terminate in barbs 205. The barbs may be advantageously used in some circumstances where it is desirable to lock the shock sensor into slots on a circuit board to prevent its movement before the shock sensor 220 is soldered to the circuit board. Additionally, where no coil is employed, the barbs 205 provide additional stability in positioning and anchoring the shock sensor on a circuit board.

As shown in FIG. 6, the shock sensor 222 has leads 288 which fit into slob 296 which facilitate the machine loading of reed switches from first one side and then the other of the shock sensor 222.

It should be understood that because the tolerancing of the placement of the glass capsule 82 exhibits a wider tolerance in the placement of the contact areas 86 of the reeds 84, a relief notch 128 may advantageously be formed on the second portion 28 of the housing to allow the glass capsule portion forming the first end of the reed switch to enter into engagement with slot 96 without coming into interfering engagements with the housing 28.

It should be understood that the shock sensor 20 can be employed with reed switches of varying configuration including those that are normally closed or employ a single reed. It should also be understood that the reed switch while capable of being hermetically sealed will function satisfactorily in many circumstances without hermetic sealing.

It should be understood that the invention is not limited to the particular construction and arrangement of parts herein illustrated and described, but embraces such modified forms thereof as come within the scope of the following claims.

I claim:

1. A shock sensor comprising:

a) a housing having a first portion and a second portion;

b) a reed switch having an axially extending capsule with a first end and a second end, and having a first lead which extends from the first end and a second lead which extends from the second end, wherein the first and second leads have portions which are bent at approximately 90 degrees to the capsule, said bent portions being mounted to the housing first portion;

c) portions of the second housing portion which define a first abutment fixed to the housing in proximity to the reed switch and facing away from the capsule, and a second abutment which faces the first abutment, wherein the first abutment is between the second abutment and the reed switch;

d) a magnet slidably mounted within the housing second portion between the first abutment and the second abutment; and e) a spring which extends between the first abutment and the magnet and which biases the magnet away from the reed switch while the shock sensor is not subjected to a selected accelerative force, wherein application of an accelerative force to the shock sensor advances the magnet toward the reed switch to cause the activation of the reed switch.

2. The shock sensor of claim 1 wherein the housing second portion defines a cylindrical recess, and wherein a bobbin having an axially extending bar is fixed within said recess, and wherein the magnet has a cylindrical bore through which the bar extends.

3. The shock sensor of claim 2 further comprising at least one first disk which extends radially from the bar and engages with the cylindrical bore to position the bar axially within the second housing portion.

4. The shock sensor of claim 3 wherein the first disk defines said second abutment, and further comprising:

a) a second disk which is axially spaced from the first disk: and b) an electromagnetic coil wrapped around the bar between the first disk and the second disk, wherein application of a current to said coil produces a magnetic field.

5. The shock sensor of claim 1 wherein the housing first portion has a flexible beam with a downwardly extending segment which engages the reed switch.

6. The shock sensor of claim 1 having at least two reed switches arrayed in spaced parallel relation so as to both be activated by movement of the magnet.

7. A shock sensor comprising:

a) a housing having a first portion and a second portion which extends axially from the first portion;

b) a reed switch mounted to the housing first portion and having a glass capsule defining an axis, the capsule having a first end and a second end;

c) a tubular cavity defined by the second housing portion which extends axially away from the reed switch, wherein the second housing portion defines a closed end adjacent the reed switch;

d) a bobbin having an axially extending guide bar, wherein the bobbin is positioned within the tubular cavity;

e) a magnet centered about the guide bar;

f) a spring centered about the guide bar, wherein the spring extends between the magnet and the closed end to bias the magnet away from the closed end;

g) a first abutment formed by the closed end; and h) a second abutment spaced axially away from the first abutment, such that the first abutment is between the second abutment and the reed switch, wherein the magnet is slidably mounted to the guide bar for travel between the first and second abutments; wherein application of a selected accelerative force to the shock sensor displaces the magnet toward the first abutment to activate the reed switch, and wherein the spring and the magnet are axially aligned about the guide bar.

8. The shock sensor of claim 7 having at least a second reed switch mounted to the housing first portion, wherein the second reed switch has a second glass capsule defining a second axis parallel to the axis of the reed switch so both reed switches may be activated by movement of the magnet.

9. The apparatus of claim 7 further comprising:

a) a first disk extending radially outwardly from the guide bar, forming the first abutment;

b) a second disk extending radially outwardly from the guide bar and spaced along the guide bar away from the reed switch; and c) a coil of wire rapped around the guide bar and between the first and the second disks, for being energized with a electric current to magnetically interact with the magnet.

10. The shock sensor of claim 9 wherein the housing first tubular portion closed end forms a hermetic seal and wherein a disk extends radially outwardly from the guide bar and is spaced along the guide bar away from the reed switch is hermetically sealed to the housing.

11. The shock sensor of claim 10 wherein a hermetic seal is formed by a cast-in-place material which surrounds a portion of the bobbin adjacent to the disk and seals the bobbin to the housing.

12. The shock sensor of claim 8 wherein the bobbin guide bar has a conical end, and wherein the second housing portion closed end has a protruding nubbin formed thereon, and the protruding nubbin has a concave cavity which engages with the guide bar conical end to center said bar within the tubular cavity and axially align the bar and the magnet mounted thereon with respect to the reed switch.

13. A shock sensor comprising:

a) a housing;

b) a reed switch mounted to the housing to define an axis;

c) a ferromagnetic lead which extends radially from the reed switch;

c) a first abutment fixed to the housing in proximity to the reed switch and facing away from the reed switch;

d) a second abutment spaced axially from the lead, wherein the first abutment is intermediate between the second abutment and the lead;

e) a magnet slidably mounted to the housing for travel between the first abutment and the second abutment, wherein a magnetic attraction force is exerted between the magnet and the reed switch lead; and f) a spring extending between the first abutment and the magnet, wherein the spring biases the magnet against the second abutment when the shock sensor is not subjected to an accelerative force of a selected level, and wherein an accelerative force of a selected level causes the magnet to be displaced against the first abutment, and wherein the spring exerts a biasing force away from the reed switch which is less than the magnetic attractive force between the magnet and the lead when the magnet is positioned adjacent the first abutment, thereby latching the magnet in the activated position.

14. The shock sensor of claim 13 having at least a second reed switch mounted to the housing and having a second glass capsule defining a second axis parallel to the axis of the reed switch so both reed switches may be activated by movement of the magnet.

15. A shock sensor comprising:

a) an axially extending housing having a first portion with two downwardly depending members connected by a flexible beam, wherein the housing has a second portion extending away from the flexible beam which defines a tubular cavity;

b) at least one reed switch mounted to the housing first portion between the two downwardly depending members, wherein one of said members is pivotable upwardly on the beam to facilitate insertion of the reed switch into the housing;

c) a bobbin having an axially extending bar and portions which extend radially from the bar, wherein the bobbin is inserted within the housing second portion tubular cavity, and wherein the radially extending bobbin portions position the bar with respect to the housing;

d) a magnet slidably mounted on the bobbin bar for travel within the tubular cavity;

e) a spring engaged with the magnet, wherein the spring biases the magnet away from the reed switch, such that when the shock sensor is not subjected to an accelerative force of a selected level the reed switch is not activated, and wherein an accelerative force of a selected level causes the magnet to be displaced toward the reed switch to activate the reed switch.

16. The shock sensor of claim 15 wherein at least two reed switches are mounted to the first portion of the housing, and wherein the magnet is slidable within the housing second portion to activate both reed switches.

17. The shock sensor of claim 15 wherein a juncture is defined between the first housing portion and the second housing portion, and wherein said at least one reed switch has a first lead and a second lead, and wherein the first lead extends radially outwardly through a hole defined by portions of the juncture, such that the reed switch is insertable in the housing by insertion of the first lead through the juncture hole and rotation of the reed switch about an axis defined by the inserted first lead into alignment along the axis of the housing first portion.

* * * * *